US005657991A

United States Patent [19]

Camarato

[11] Patent Number: 5,657,991

[45] Date of Patent: Aug. 19, 1997

[54] INTERACTIVE BINGO-LIKE GAMES AND METHOD OF PLAYING

[75] Inventor: Keith L. Camarato, Herrin, Ill.

[73] Assignee: Media Drop-In Productions, Inc., Hartford, Conn.

[21] Appl. No.: 507,722

[22] Filed: Jul. 26, 1995

Related U.S. Application Data

[63] Continuation-in-part of Ser. No. 95,203, Jul. 23, 1993, abandoned.

[51] Int. Cl.[6] ..... A63F 3/06

[52] U.S. Cl. ..... 273/269; 273/139; 283/901

[58] Field of Search ..... 273/269, 289, 273/139; 283/100, 101, 102, 103, 105, 901, 903

[56] References Cited

U.S. PATENT DOCUMENTS

| | | | |
|---|---|---|---|
| 4,491,319 | 1/1985 | Nelson | 273/139 X |
| 4,740,016 | 4/1988 | Konecny et al. . | |
| 4,775,155 | 10/1988 | Lees | 283/903 X |
| 5,074,566 | 12/1991 | Desbiens . | |
| 5,092,598 | 3/1992 | Kamille . | |
| 5,118,109 | 6/1992 | Gumina . | |
| 5,193,815 | 3/1993 | Pollard . | |
| 5,217,258 | 6/1993 | Sanderson | 283/903 X |
| 5,269,523 | 12/1993 | Boylan et al. | 273/269 X |

FOREIGN PATENT DOCUMENTS

| | | | |
|---|---|---|---|
| 2166961 | 5/1986 | United Kingdom | 273/269 |

OTHER PUBLICATIONS

"Strike It Rich", Lottery Ticket, Jan. 1979, 273/139.
"Pennsylvania Instant Bingo", Jul. 1977, 273/139.

*Primary Examiner*—William M. Pierce
*Attorney, Agent, or Firm*—Shlesinger, Arkwright & Garvey LLP

[57] ABSTRACT

The game simulating apparatus is particularly suited for playing bingo-like games such as bingo and keno. The game simulating apparatus is engineered so that it can be in the form of a pull tab type game card, a scratch off type game card, or an electronic game displayed on a video display terminal. Both sponsor's areas and player's areas are provided in the same game simulating apparatus for enhancing the suitability and interchangability of the game between different modes (i.e., pull tab cards, scratch off cards, and video display terminals) as well as for enhancing the play value and interest value for the player of the game.

4 Claims, 2 Drawing Sheets

INTERACTIVE BINGO-LIKE GAMES AND METHOD OF PLAYING

This application is a continuation-in-part, application Ser. No. 08/095,203, filed Jul. 23, 1993, now abandoned, which is incorporated herein by reference.

FIELD OF THE INVENTION

This invention relates to games involving matching ones of a first set of numbers with others of a second set of numbers, the quantity of numbers selected being determined by one or both of the player and the sponsor of the game.

BACKGROUND OF THE INVENTION

Bingo and bingo-type games, such as keno, are well known.

In traditional bingo, the sponsor or bingo-providing authority distributes bingo cards on which 24 randomly selected numbers from between 1 and 75 are printed. The sponsor withdraws balls from a hopper during the play of a particular bingo game. There are 75 balls in a hopper or other container, and the game sponsor draws out one at a time, calling out the number printed thereon.

The bingo cards are traditionally printed in a 5×5 array with the centermost one of the 25 squares being labelled "F" (representing a "free" spot). Depending on the variation of bingo being played, a player wins when he or she has matched five numbers in a row or column, or on a diagonal extending through the "F" spot.

Other bingo variations provide for a winner when all 24 numbers on the player's bingo card have been matched with the numbers called out by the sponsor. Generally, the sponsor provides its largest jackpot or payoff to the winning player, during the bingo game called "blackout" or "cover-all". The player achieves a blackout by matching the 24 numbers on the player's bingo card within a predetermined limited number of calls called out by the sponsor's caller.

There are known instant bingo games and game cards therefor, such as U.S. Pat. No. 5,193,815 to Pollard in which a game card or bingo card has a first area on which a series of numbers corresponding to the numbers which would be called out by the caller in a live bingo game are represented. There are four other player's cards corresponding to a bingo player's traditional playing card provided on another part of the Pollard game card. The user of the Pollard game card must scratch off one or more colored layers of material which hides the preprinted numbers on the player's game card. The Pollard bingo card has multiple layers, including a colored, translucent layer and an opaque latex coating, such as conventionally used in so-called "scratch off" lottery tickets as distributed by many states. The Pollard instant bingo game card is expensive to print and difficult to use owing to its complicated format. The Pollard game card is not designed for playing "blackout" nor for paying out consolation prizes.

U.S. Pat. No. 5,074,566 to Desbiens discloses another two-level scratch game in which a player scratches off one or more layers of latex material covering hidden numbers printed on the game card. The Desbiens scratch off game card is complicated to manufacture and difficult to play.

U.S. Pat. No. 5,092,598 to Kamille discloses a lottery game type game card, including a version of conventional keno in which the player must scratch off 10 out of the 80 latex covered boxes in order to reveal the player's hidden numbers, in an attempt to match revealed numbers with the 10 winning numbers. The player must scratch off only 10 of the 80 numbers or the Kamille game card is voided. Kamille discloses a spaced apart, separate, eleventh game number which can be revealed by scratching off to provide a bonus play.

Accordingly, there is a need for a straightforward instant game card for bingo-type games which is both easier and less expensive to manufacture than known instant game cards, is easier for a player to use, cannot be accidentally voided by the player by inadvertently destroying parts of the game card or by scratching off too many latex covered areas, and which is provided in a universal format. By "universal" I mean throughout the specification that my bingo-type game is suited for being constructed and played on the three common types of game media: pull tab game cards; game cards having scratch off surfaces made of opaque latex coatings and the like; and video display terminals providing graphic representations of my bingo-like game. My new game and method of playing the game have been realized by the game format and method of playing my game described in detail below.

OBJECTS AND SUMMARY OF THE INVENTION

An important object of the invention is to provide a new bingo-type game format which lends itself to being played on pull tab game cards, scratch off game cards, and video display terminals.

Another object of the invention is to provide a new bingo type: game which can be used to play traditional bingo.

A further object of the invention is to provide a bingo type: game which more closely resembles live bingo play.

Yet another object of the invention is to provide a game format which captures the excitement of live bingo.

A still further object of the invention is to provide a new game format which makes it possible to play "blackout" on a pull tab card, a scratch off card, and on a video display terminal. format.

Another object of the invention is to provide a new bingo type game in which there are multiple winners, i.e., there are consolation winners, whereby the game format has added excitement owing to the increased chance of a player being a winner, and whereby play by players of the game format is encouraged, thanks to there being a higher percentage of winners.

A still further object of the invention is to provide a new game format which is suitable for playing keno.

Yet another object of the invention is to provide a game format which, in its pull tab game card embodiment is less expensive to manufacture than known game cards.

Yet another object of the invention is to provide a game format in which the scratch off card embodiment is less expensive to manufacture than existing single and multi-layer type scratch off game cards.

It is a still further object of the invention to provide a less expensive game card format for bingo-type games so that more money is available to the sponsors, such as charitable organizations.

A yet still further object of the invention is to provide a single bingo-type game format which can be used for playing games having different prize payout levels.

Yet another object of the invention is to provide a bingo-type game format which can be more easily played by people having severe arthritis, and other physical handicaps.

A yet still further object of the invention is to provide a game format for bingo-like games that can be played without the need for making any marks on a game card.

Yet another object of the invention is to provide a bingo-type game format which provides a sponsor with consistent, predetermined odds of a player's winning; namely, a consistent sponsor's payout, so that a sponsor has known fixed payout costs.

A still further object of the invention is to provide a game format for bingo-like games that provides for different prizes to be awarded on a single scratch-off ticket and/or a single play of a video game.

Another object of the invention is to provide a bingo-type game format which provides for enhanced player interest.

A yet still further object of the invention is to provide a bingo-type game format which provides for a multiple number of prizes to be awarded, dependent on the number of "called" or "revealed" sponsor's numbers which have been revealed/provided to the game player.

Another object of the invention is to provide a bingo-type game format which provides a sponsor with a consistent sponsor's payout, yet with a game that in its self has variable payouts.

It is still another object of the invention to eliminate the need for latex material scratch off coverings which are difficult to use, and which generate messy particles of latex material which must be wiped off of a player's hands, and which a sponsor must clean up from the sponsor's game area.

Throughout the specification, in describing my invention, the term "format" refers to the manner in which the game information is displayed, whether the game information is printed on a scratch off type game card, a pull tab type game card, or a video display terminal. The terms "bingo" and "keno" refer to all types of games in which a player matches one or more of the player's numbers to a corresponding one or more numbers designating a sponsor's selected numbers. The term "closed" or "unopened" refers to the state of the game format in which the sponsor's numbers and/or the player's numbers are hidden from the player's view. "Open" refers to the state in which the sponsors and/or the players numbers are viewable by the player.

DETAILED DESCRIPTION OF THE INVENTION

Figure 1:
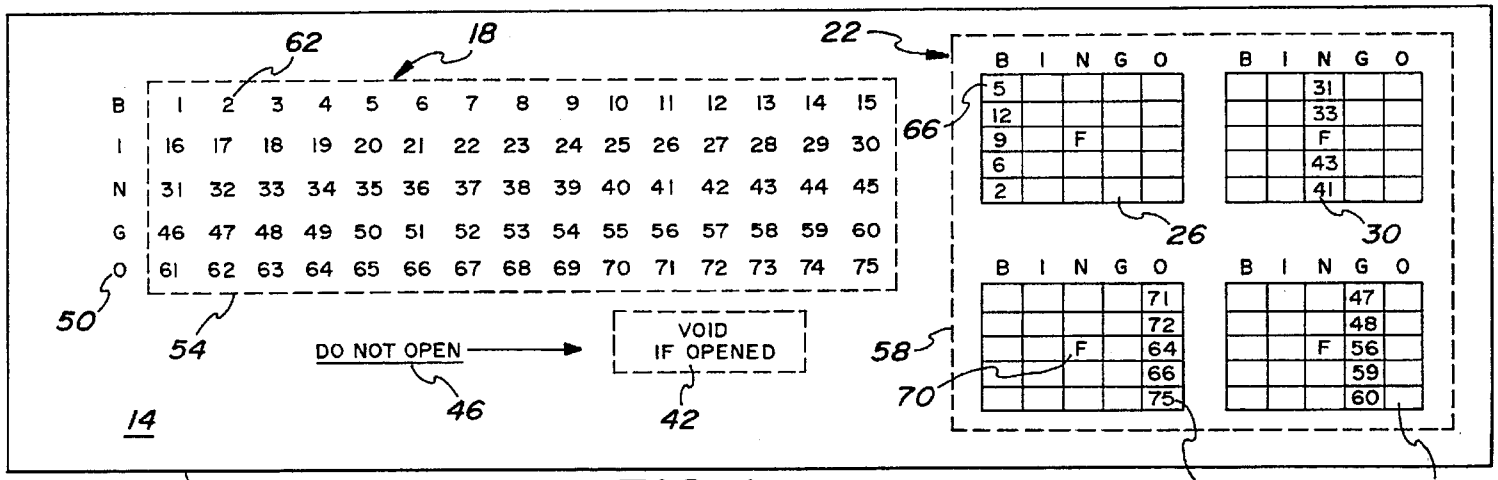
FIG. 1 is a somewhat schematic representation of a game format according to my invention, in its "unopened" state, according to a preferred embodiment of my invention.

FIG. 1 illustrates a game simulating apparatus 10, particularly suited for playing bingo-like games such as bingo and keno.

Game simulating apparatus 10 is configured according to one preferred embodiment as a game card such as a pull tab type game card or a scratch off type game card. In addition, in another preferred embodiment of the invention, the game simulating apparatus 10 is a video display terminal (VDT).

Accordingly, in the case of a game card, one or more substrates 14 or a video display terminal 14 in the case of a computer-generated game is provided. Substrate or VDT 14 is divided into one or more areas containing information, such as a sponsor's area 18 and a player's area 22.

Preferably, player's area 22 is divided into four subareas 26, 30, 34 and 38.

Preferably, a control area 42, especially in the case where game simulating apparatus 10 is a game card type device, such as a pull tab card, includes a control area 42 having a warning label such as "VOID IF OPENED" and under which identifying information, control numbers, or a control device are concealed, as will be described in greater detail below. An additional warning or label, e.g., "DO NOT OPEN" 46 may be provided in the case of a pull tab type game card embodiment. In the case of a scratch off type game card, an analogous warning may be provided, e.g., "DO NOT SCRATCH OFF" or "DO NOT REVEAL".

Game identification information 50, shown as "BINGO" inherently provides a player with a short hand version of the rules, when conventional BINGO, as illustrated or unillustrated keno, for example, is the game being simulated. Additional rules may be provided on the unillustrated back of a game card embodiment, or, in the case of a video display terminal format, on a different screen or a different part of the illustrated screen.

A plurality of tear lines 54 surround sponsor's area 18. Tear lines 18 will be used when game simulating apparatus is a pull tab type game card. Tear lines 54 are conventionally constructed by partially scoring or cutting through an upper layer of substrate 14. In the case of a scratch off type game card, tear lines 54 are representative of the boundary of an opaque latex substrate or first opaque layer covering sponsor's area 18. When game simulating apparatus 10 is a video display terminal, tear lines 18 are formed as computer images of tear line 18 or designate a change in color between the simulated sponsor's area 18 and the surrounding simulated substrate 14, for example.

A plurality of tear lines 58 surround player's area 22 and are similar in function and construction to tear lines 54 described immediately above.

Conventional numbers 1 through 75 representing the traditional 75 different numbers possible in a conventional game of bingo are illustrated as by representational character 62 on the surface of sponsor's area 18, in the case of pull tab type game card.

In the case where game simulating apparatus 10 is a scratch off type game card, conventional number characters 62 can be printed on top of the scratch off latex material during the printing process, as is known.

When game simulating apparatus 10 is in the preferred embodiment of a video display terminal, characters 62 can be shown during idle computer time between plays and before play has been initiated by a player, for example.

It is preferred that player's area 22 include one or more sample columns 66 representing conventional numbers which are printed on a player's bingo card.

By tradition, the first or "B" column in player's area 22 includes five numbers selected from numbers 1–15, the second column or "I" column has five numbers selected from the series 16–30, the third, middle, or "N" column has four numbers selected from the series 30–45, the middle space of which being a free spot 70, designated "F" representing that the player need not match a number in order to have been given that space as part of the spaces counting towards the player's winning combination of numbers. The fourth or "G" column conventionally has five numbers selected from the series 46–60, and the fifth or "O" column has five numbers selected from the series 61–75.

For convenience, and for representing game simulating apparatus 10 in a conventional rectangular form suggestive of a pull tab card or lottery ticket, sponsor's area 18 preferably shows the 75 numbers just described in a horizontal format, whereby numbers 1–15 are shown in a row labeled "B" as opposed to the "B" column on the player's card.

This horizontal format also agrees with the convention of having a display board or "flash board" at the front of a bingo hall where the numbers which have been called by the sponsor's employee are displayed throughout the game.

In traditional bingo games, the called numbers are displayed throughout the game so that players have ample time to match called numbers to their playing card, especially as some bingo players play multiple cards at once, and physically challenged bingo players may require more time in which to match their numbers.

Figure 2:
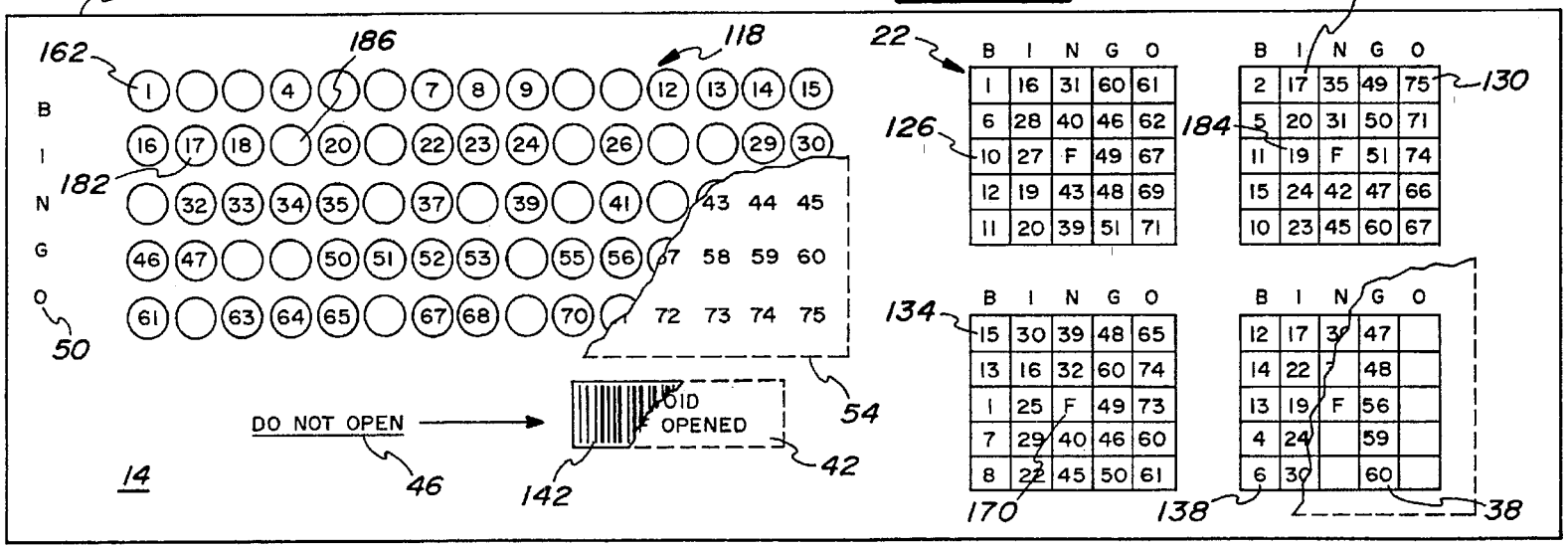
FIG. 2 is a view of the game format of FIG. 1, of the game format according to my invention in its "open" state.

FIG. 2 shows the preferred embodiment of my game simulating apparatus 10 after it has been brought into play; i.e., after the player's winning numbers have been revealed, such as in the case of a game card where the winning numbers have been uncovered.

A partially opened sponsor's area 118 is shown in the upper left of FIG. 2.

A partially opened player's area 22 is shown on the right side of FIG. 2. Completely uncovered subareas 126, 130 and 134 corresponding to subareas 26, 30, and 34 of FIG. 1 are illustrated. Partially opened subarea 138 schematically represents the relationship between covered subarea 38 and opened player's subarea 138.

A partially revealed control number 142, which is illustrated as a machine-readable barcode, and which may also be a series of letter of number codes for control purposes, is provided.

Control number 142 functions as a serial number to reduce counterfeiting efforts, and as a control number for inventory purposes. Likewise, control number 142 may have information encoded therein which corresponds to the prize value of a winning game simulating apparatus 10, for example. Still further, control number 142 may contain encoded information corresponding to what the sequence of winning numbers are. Furthermore, revealed control number can include identifying information corresponding to the sponsor which purchased the ticket or any other desired identifying information.

Revealed numbers 162 correspond to the sponsor's "called" numbers and are preferably represented as numbers inside of circles suggestive of conventional balls having a number printed thereon that are withdrawn by the sponsor's employee from a container at the front of a bingo parlor, for example.

A revealed "F" 170 is preferably provided on each of the opened player's subareas 126, 130, 134 , and 138.

In use, when my game simulating apparatus 10 is configured in the preferred embodiment of a pull tab card, the player separates the material covering sponsor's area 18 from substrate 14 by separating along tear lines 54.

The player likewise separates the material covering player's area 22 from substrate 14 by severing tear lines 58.

The player has thus revealed sponsor's "called" numbers 162.

Likewise, one, or preferably a plurality, of matched numbers 180 are revealed in player's area 22.

As can be seen from FIG. 2, "17" is the matched number 180 corresponding to a "called" number "17" designated by reference numeral 182. The player's revealed number "19" on the right side of FIG. 2 is an unmatched number 184 corresponding to an empty circle 186 on the opened or revealed sponsor's area 118. The empty circle designated 186 is located at the position in which "19" would have appeared if it had been one of the sponsor's "called" numbers revealed in opened sponsor's area 118. Revealed matched numbers 180 and revealed unmatched numbers 184 are both "assigned" player's numbers and are "winning" number in the broad conventional sense, and "potential" winning numbers in a narrower sense.

When game simulating apparatus 10 is used to play keno, the player will reveal one or more numbers in the player's area, depending upon the conventional keno rules governing play.

Depending on the percentage of money to be paid out desired by the sponsor, a controlled number of winning game cards will be distributed in a series of game cards provided to the sponsor for sale to players. In this manner, a sponsor will know exactly what the sponsors expected income will be from each box of 1000 cards sold to players, for example.

Given that free spot 70 need not be matched in traditional bingo, and in the use of the present invention, a player which has matched 24 numbers from the player's revealed or opened player's area 122 with revealed sponsor's numbers 162 will win the largest prize.

For example, if the player has matched 24 numbers, the player would be given a $1000.00 prize on a $1.00 game card taken from the sponsor's box of 4000 game cards, for example. If the player matched 23 of the numbers, the player would win $250.00, for example. If the player matched only 22 numbers, the player would win $50.00. Twenty-one matched numbers would have a $10.00 payout, 20 matched numbers would have a $5.00 payout, and so forth. In other words, the game outcome is determined by the count of the player's set of potential winning numbers which match the revealed sponsor's numbers being the same as the count of a predetermined sum of winning matching numbers.

In the case that the game card, or video display terminal game, is played for a smaller amount of money, the prize money or payout would be corresponding lower.

Figure 3:
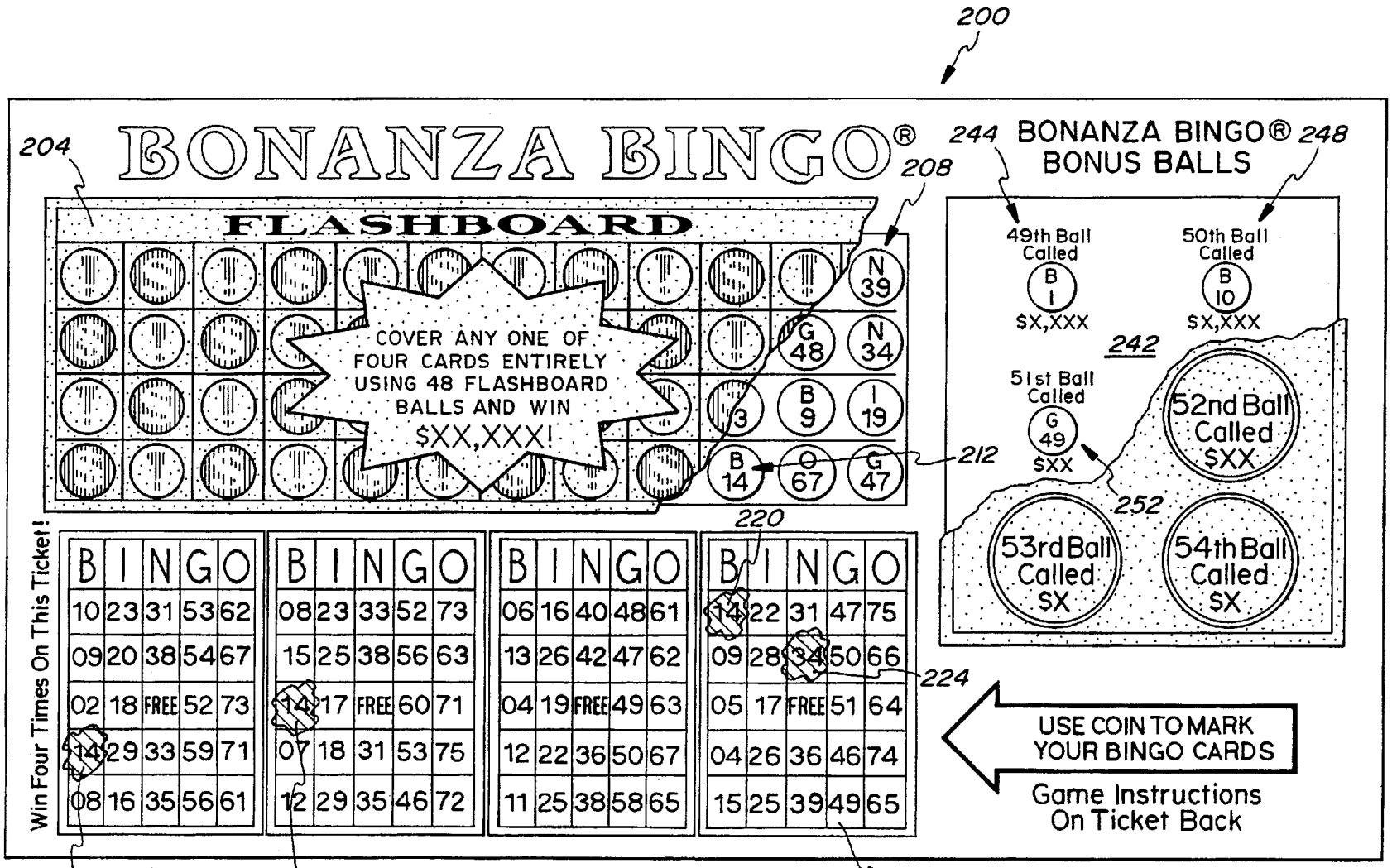
FIG. 3 is a representation of a game format according to a further preferred embodiment of my invention, in a partially "unopen" state and a partially "open" state.

FIG. 3 illustrates a further preferred embodiment of my invention, illustrating schematically a game simulating apparatus 200 which may be, made in any of a number of formats, such as scratch off cards, displays on a video display terminal, and the like, as in the preferred embodiment of FIGS. 1 and 2.

Game display format 200 includes a sponsor's or house display area, illustrated as being partially removed on the right side, showing "called" numbers 208 such as N39, G48, N34, B9, I19, B14, O67 and G47. One of revealed numbers 208, such as revealed number B14, designated 212, is matched with corresponding numbers on the player's four display bingo cards in the play's play area as in the earlier embodiment. Revealed number B14 is illustrated as having been matched with marked numbers 14, as shown at areas 216, 218, and 220, in 3 of the 4 illustrated player's bingo cards. The player has likewise marked number 34 (or N34) as shown at area 224 of the lower right hand one of the player's bingo cards.

In the illustrated example, when all 48 of the sponsor's numbers have been revealed, the player would have matched each one of corresponding numbers in each one of the four player's cards to determine if any of the player's cards was a winning card according to the rules governing play. In this preferred embodiment, a further player's area 242 is provided in the upper right of FIG. 3 which is provided to give the player one or more additional chances to win. In other words, a "49th Ball" as shown in sub area 244 can be revealed to give the player yet another opportunity to win.

As will be appreciated, the prize or payout will typically be lower when the player is required to use the number revealed/corresponding to the 49th Ball in area 244 in order to make one of the player's bingo cards a winning bingo card.

As illustrated, a second bonus ball can be provided in area 248, the so called "50th ball." As with the 49th ball from area 244, the number provided in that area will be matched by the player to determine whether a winning card is yielded by use of 50 sponsor's revealed balls, as opposed to 49 revealed balls, and of course, as opposed to 48 revealed balls. Still further, a 51st ball as shown in a further area 252 can be provided. It can be seen that in the lower right players bingo card a "49" appeared in area 256 which would be marked when the 51st ball has been reached and a winning card has not been achieved.

It will be readily appreciated that an overzealous or novice player engaged in play on the embodiment of FIG. 3 is unable to inadvertently reduce the winning payout on his or her game card 200 when all 48 initial balls are revealed according to play, and bonus balls are used. For example, is the player has not won after having revealed the initial 48 balls in region 204, the winner can reveal the 49th ball alone in area 244, or all 6 additional bonus balls (i.e. the 49th though 54th balls) and the sponsor can still determine that it was the 49th ball revealed that corresponded to a winning ball, as opposed to the 52nd ball revealed and the higher payout corresponding to the 49th ball can be given to the player. Of course, the sponsor can use its own rules in accordance with the invention and strictly enforce a requirement that only one additional bonus ball be revealed at a time.

It is likewise contemplated that in the basic sponsor's area 204, each revealed number can be revealed in sequence, for example, starting from the top left and heading to the top right before beginning on the second row down at the far left and continuing on to the right, whereby different payouts could be given depending on the number of the basic 48 balls which can be revealed have been revealed. In a video game format, it is contemplated that the player could reveal anyone of the 48 basic numbers in sponsor's area 204, and the sequence in which each number has been revealed, and/or the overall count of revealed numbers be tracked, so that typically correspondingly higher payouts will be given for a winning combination having been revealed by use of a lesser amount of revealed numbers. For example, it will be readily appreciated that if one has a winning bingo card when only 4 numbers have been revealed, the payout would generally be higher then if a winning combination had been achieved when 24 numbers had been revealed. For example, it is possible that the lower right players bingo card could be a winning card when just the following 4 numbers had been revealed: N31, N34, N36, and N39, whereby a line of numbers filling the "N" column has been made, with the "free" spot providing the fifth "number" in the row to yield a winning card.

As described above, in a case where all 48 basic possible numbers are revealed in sponsor's area 204, it is then that the bonus balls will typically come into play. It is contemplated that additional variations be made with a lesser number of standard initially revealed numbers displayed in sponsor's region 204. That is, the sponsor would determine or establish the number or count of sponsor's revealed balls that must correspond to (e.g., have the same numerical value as the player's revealed balls in order for the player to have revealed a winning combination of numbers (e.g., combination of sponsor's revealed balls). Quite simply, the sponsor establishes how many revealed balls and of what type it takes to win.

The player counts the player's revealed balls (e.g., player's potential winning numbers) which match the revealed sponsor's balls. That player's count is compared or matched with the above-described predetermined count, and the game outcome is determined. As described above, a game outcome is determined such as when revealed player's balls N31, N34, N36, and N39 match sponsor's revealed balls. An aspect of the predetermined count may be how many sponsor's balls had to be revealed in order to yield a winning count, as described. When the required count is reached or equaled, the game outcome is determined.

It is further contemplated that the game cards be printed in different colors, the color red corresponding to a $100.00 grand prize game, the color green corresponding to a $500.00 grand prize game, the color blue corresponding to a $100.00 grand prize game, and the color gold corresponding to a $10.00 grand prize game, for example. The corresponding preferred embodiment of a video display terminal based game would have its background electronically generated color likewise altered.

It is further contemplated that yet another covered subarea be provided under which a color or grand prize dollar amount be displayed corresponding to the value of the ticket. In that fashion, the player would reveal the "color" of the game, and enjoy added excitement when the "color" of the game revealed corresponds to a high grand prize payout.

It also contemplated that the format of the game will be changed within the scope of my invention depending on state, federal, tribal, and local laws governing the use and play of bingo-type games, as well as being governed by the traditional format expected by players in particular geographic areas. For example, many states have pull tab type game cards in their array of instant win type lottery games, while other states conventionally use scratch off type game cards.

It is contemplated that when keno is the simulated game, the conventional 80 numbers will be provided, and the player will select from 1 to 20 numbers in the player's area.

It is likewise contemplated that one large tab be used to reveal both the sponsor's area and the player's area, or that single tabs be used to reveal as few as one number on one player's bingo card at a time. By revealing as few as one number at a time,, or by revealing one column of a player's numbers at a time, tension is increased and the inventive game more closely resembles like bingo. Increased tension is achieved because a winning player reveals more and more numbers corresponding to the sponsor's revealed numbers. For example, if the player has revealed the first four columns, e.g., the "B", "T", "N", and "G" columns and has had twenty (20) matching numbers, each additional matching number revealed in the "O" column will increase the payout. Thus, each number left to be revealed will add to the player's anticipation of a bigger win, and the excitement and tension of live bingo play will be achieved.

It is further contemplated that combinations of scratch off and pull tab cards in which some subareas are scratch off and some subareas are covered by pull tabs be provided.

It is likewise contemplated that in the case of the video display terminal embodiment of the invention, the screen would have conventional touch sensors provided so that the player could play the game by simply touching the screen with the player's finger, or by pressing keys on a terminal or control pad.

As regards each of the foregoing embodiments, it should be understood that the bingo-type game may be played interchangeably as a video format game on a video display terminal, as a pull tab game, or as a scratch off game, Although pull tab games, scratch off games, and video display terminals have been used for casino type gambling games, the game simulating apparatus in the format described above provides interchangability between the three formats which are highly desirable and important aspects of this invention.

It is further contemplated that symbols, pictures, letters, and other representational values be used in conjunction with or instead of numbers.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, fall within the scope of the invention and of the limits of the appended claims.

I claim:

1. A method of using a game simulating apparatus, comprising the steps of:

a) providing a game display;

b) providing an unrevealed sponsor's area having a set of invisible numbers covered by a first opaque layer and representing a sponsor's potential called numbers;

c) providing an unrevealed bonus ball display area having at least one invisible number covered by a second opaque layer and representing a sponsor's potential bonus called number;

d) providing a player's area having a set of player's potential winning numbers;

e) removing the first opaque layer for changing said unrevealed sponsor's area into a revealed sponsor's area displaying a sponsor's revealed set of winning called numbers;

f) removing the second opaque layer for changing said unrevealed bonus ball area into a revealed bonus ball area displaying a sponsor's revealed bonus called number;

g) establishing a predetermined count of revealed winning called numbers and winning bonus called numbers to be matched with ones of said player's potential winning numbers to determine the outcome of the game;

h) counting said player's potential winning numbers which match ones of said revealed winning called numbers displayed in said revealed sponsor's area and which match said revealed bonus called number displayed in said revealed bonus ball area to yield a count;

i) comparing the count in step (h) with said predetermined count in step (g) to determine the game outcome; and, j) whereby, the game outcome is determined by the count of step (h) at least equalling the predetermined count.

2. A method as defined in claim 1, wherein:

a) said step of providing a game display includes providing a video display terminal.

3. A method as defined in claim 1, wherein:

a) said step of providing a game display includes providing a game card.

4. A method as defined in claim 3, wherein:

a) in said step of providing a game card, said game card includes an area which has the appearance of a flashboard.

* * * * *